US007254349B2

(12) United States Patent
Kamiya

(10) Patent No.: US 7,254,349 B2
(45) Date of Patent: Aug. 7, 2007

(54) IMAGE FORMING APPARATUS HAVING MEANS TO CONTROL CONDITION OF CURRENT SUPPLY TO DISCHARGE WIRE AND GRID OF CHARGING MEMBER

(75) Inventor: Yuji Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 11/016,873

(22) Filed: Dec. 21, 2004

(65) Prior Publication Data

US 2005/0200309 A1 Sep. 15, 2005

(30) Foreign Application Priority Data

Dec. 24, 2003 (JP) ..... 2003-428472

(51) Int. Cl.
*G03G 15/02* (2006.01)

(52) U.S. Cl. ..... 399/50; 399/171

(58) Field of Classification Search ..... 399/168–171, 399/50

See application file for complete search history.

(56) References Cited

U.S. PATENT DOCUMENTS 5,469,243 A 11/1995 Saitoh et al.
5,481,337 A 1/1996 Tsuchiya et al.
5,610,689 A 3/1997 Kamiya et al. ..... 399/31
6,418,280 B2 7/2002 Kamiya ..... 399/46
6,493,524 B2 12/2002 Kamiya ..... 399/48
2001/0046060 A1 11/2001 Kamiya ..... 358/1.13

FOREIGN PATENT DOCUMENTS

JP 6-274012 9/1994
JP 11184215 A * 7/1999

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image forming apparatus is provided with an image bearing member, a charging member with a discharge wire and a grid, and a first current supply controlling member, which controls a current supply to the discharge wire. Also provided are a second current supply controlling member, which controls a current supply to the grid, a potential setting member, which sets a potential value on the image bearing member to be charged by the charging member, and a first current supply condition selecting member, which selects a current control condition of the first current supply controlling member or the second current supply controlling member according to the set potential. In addition, a second current supply condition selecting member selects a current control condition for the other current supply controlling member based on the determined current control condition.

7 Claims, 13 Drawing Sheets

FIG. 11

| | CONVENTIONAL ART | EMBODIMENTS | | |
|---|---|---|---|---|
| DISCHARGE WIRE CURRENT Ipr | 1200μA (FIXED) | 900 TO 1400μA VARIABLE | | |
| AREA OF USE OF Ipr | DITTO | AROUND 900μA | AROUND 1200μA | AROUND 1400μA |
| UPPER LIMIT OF DARK SECTION POTENTIAL | 400V | 330V | 400V | 480V |
| LOWER LIMIT OF DARK SECTION POTENTIAL | 170V | 100V | 170V | 230V |
| DARK POTENTIAL RANGE | 170 TO 400V | 100 TO 480V | | |

IMAGE FORMING APPARATUS HAVING MEANS TO CONTROL CONDITION OF CURRENT SUPPLY TO DISCHARGE WIRE AND GRID OF CHARGING MEMBER

BACKGROUND OF THE INVENTION

1. Field of the Invention

The present invention relates to an image forming apparatus such as a printer, a copying apparatus or a facsimile apparatus, and more particularly to an image forming apparatus which executes a potential control on a surface of an image bearing member by a scorotron charger.

2. Related Background Art

As a charger for uniformly charging a surface of an image bearing member (such as an electrophotographic photosensitive drum) employed in an image forming apparatus such as a printer, a copying apparatus or a facsimile apparatus, a scorotron charger has been widely employed.

A scorotron charger charges an electrophotographic photosensitive member to a desired surface potential by means of a current or a voltage applied to a discharge wire for causing a discharge, and a current or a voltage applied to a grid for regulating the potential on the image bearing member at a predetermined potential. There have been proposed a method of fixing the voltage applied to the grid and regulating the current or the voltage applied to the discharge wire thereby obtaining a desired surface potential, and a method of fixing the current or the voltage applied to the discharge wire and regulating the current or the voltage applied to the grid thereby obtaining a desired surface potential.

For fixing the voltage applied to the grid, there is also widely employed a method of employing a constant voltage element such as a varistor in combination with a high voltage source and regulating the potential of the grid at a predetermined value through an exchange of charge from the discharge wire.

Also for regulating the current or the voltage of the discharge wire, there is available a device capable of regulation for example with a switch, and there is also proposed a circuit having a variable resistor combined with a varistor for changing a voltage applied to the grid.

However, the method of fixing the voltage applied to the grid is associated with following drawbacks. In case of regulation to a high surface potential, it is necessary to select an excessively high voltage or current to the discharge wire, since the grid voltage is fixed. As a result, there results a drawback that the discharge wire is conspicuously smeared. On the other hand, in case of regulation to a low surface potential in a state where the grid voltage is set high in order to avoid the aforementioned phenomenon, it is necessary to reduce the voltage or the current to the discharge wire, and, as a result, a smear on the discharge wire is reproduced on an image. Therefore, in case of fixing the voltage applied to the grid, it is not possible to obtain a sufficiently wide regulating range of the surface potential.

On the other hand, in case of fixing the current or the voltage of the discharge wire and executing a regulation by the current or the voltage of the grid, a high current or voltage of the grid results in a large potential difference between the grid and the photosensitive member, thereby tending to induce a spark discharge therebetween. As a result, a high voltage or a high current cannot be applied so that a high surface potential cannot be obtained on the photosensitive drum. On the other hand, it is also conceivable to increase a current or a voltage to the discharge wire, but a constantly increased current to the discharge wire is undesirable as it aggravates the smear on the discharge wire. Therefore, in case of fixing the current or the voltage applied to the discharge wire, as in the method of fixing the voltage to the grid, it is not possible to widen the regulating range of the surface potential.

On the other hand, Japanese Patent Application Laid-open No. 06-274012 discloses a method in which a main charging voltage of the discharge wire and a grid voltage are both made variable in order to widen the regulating range of the surface potential. In this method, plural characteristics of the main charging voltage and the surface potential of the photosensitive member at different grid voltages are activated in succession, and a desired surface potential is realized at a main charging voltage as low as possible in such characteristics.

This method, however, has a drawback of requiring a long control time before an appropriate state can be obtained, as plural characteristics are activated in succession. Also a low voltage applied to the discharge wire as a main charging voltage requires a constantly higher grid voltage, thereby depriving the grid of its inherent rectifying effect. For this reason, in case a discharge unevenness is caused by a deterioration in time for example in the discharge wire, the rectifying effect of the grid is suppressed to result in a drawback such as an unevenness in the potential of the photosensitive member.

SUMMARY OF THE INVENTION

An object of the present invention is to achieve a potential regulation over a wide range within a short time without a constant increase of the current to the discharge wire.

Another object of the present invention is to provide an image forming apparatus including an image bearing member, charging means which has a discharge wire and a grid and which charges the image bearing member, first current supply control means which controls a current supply to the discharge wire, second current supply control means which controls a current supply to the grid, potential setting means which sets a potential value on the image bearing means to be charged by the charging means, first current supply condition selecting means which selects a current control condition of the first current supply control means or the second current supply control means according to the set potential, and second current supply condition selecting means which selects a current control condition for the other current supply control means based on the determined current control condition.

Still other objects of the present invention will become apparent from the following description.

BRIEF DESCRIPTION OF THE DRAWINGS

FIG. 11 is a table showing a comparison of a prior technology and the embodiment of the present invention;

DETAILED DESCRIPTION OF THE PREFERRED EMBODIMENTS

In the following, embodiments of the present invention will be explained with reference to accompanying drawings, in which like numbers represent components of same configurations or functions and descriptions on such components are not repeated suitably.

Embodiment 1

Figure 1:
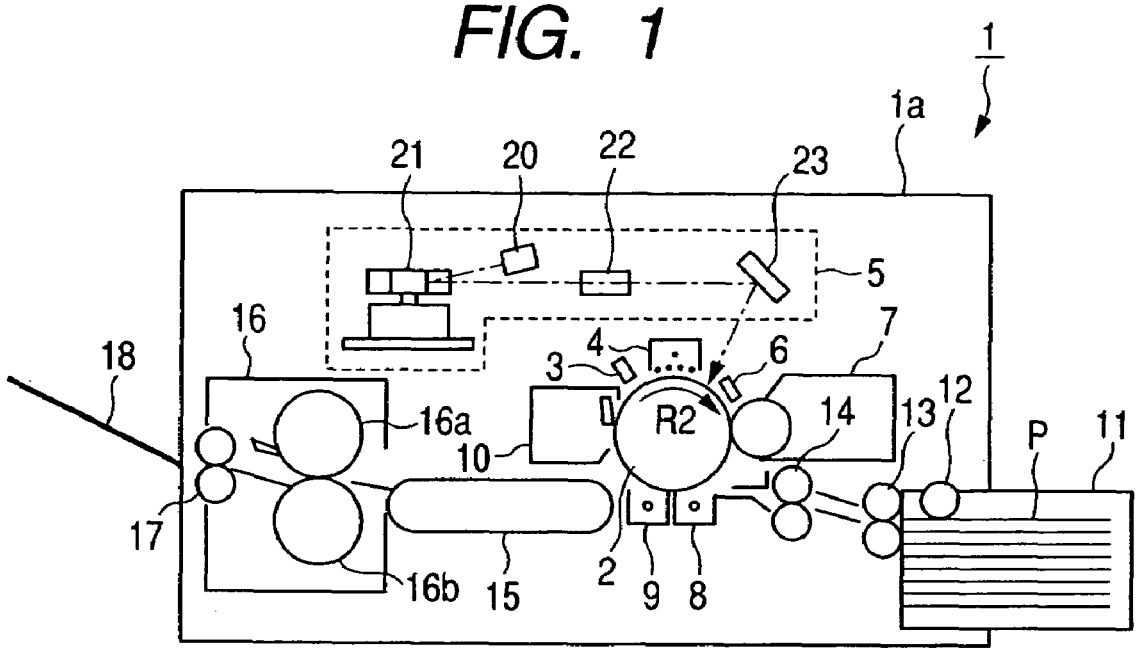
FIG. 1 is a schematic view showing a configuration of a copying apparatus as an example of an image forming apparatus.

FIG. 1 illustrates an example of an image forming apparatus of the present invention. An image forming apparatus shown in FIG. 1 is an electrophotographic printer, of which configuration is schematically shown in FIG. 1. The image forming apparatus of the present invention can be, in addition to the electrophotographic printer mentioned above, for example also a copying apparatus or a facsimile apparatus of an electrophotographic process, or a printer, a copying apparatus or a facsimile apparatus of an electrostatic recording process.

Now reference is made to FIG. 1 for explaining the schematic configuration and the function of the entire image forming apparatus 1.

The image forming apparatus 1 illustrated in FIG. 1 is provided, in a main body of the image forming apparatus, with an electrophotographic photosensitive member 2 of a drum shape as an image bearing member (hereinafter called "photosensitive drum").

The photosensitive drum 2 is supported rotatably in a direction R2 in a main body 1*a* of the apparatus, and along the periphery of the photosensitive drum 2 and in the order along the rotating direction thereof, there are provided a charge eliminator (charge elimination means) 3 for erasing a potential on the surface of the photosensitive drum 2, a primary charger (charging means) 4 for uniformly charging the surface of the photosensitive drum 2, an exposure apparatus (exposure means) 5 serving as latent image forming means which exposes the surface of the photosensitive drum 2 after uniform charging thereby forming an electrostatic latent image, a potential sensor (potential detection means) 6 for measuring a potential on the surface of the photosensitive drum 2 after the exposure, a developing apparatus (development means) 7 for depositing a one-component magnetic toner (developer) onto the electrostatic latent image thereby forming a toner image (developer image), a transfer charger (transfer means) 8 for transferring the toner image on the photosensitive drum 2 onto a transfer material P as a transfer medium (such as paper or a transparent film of sheet shape), a separation charger (separation means) 9 for separating the transfer material P after the toner image transfer from the photosensitive drum 2, and a cleaner (cleaning means) 10 for removing a residual toner on the photosensitive drum 2.

Figure 2:
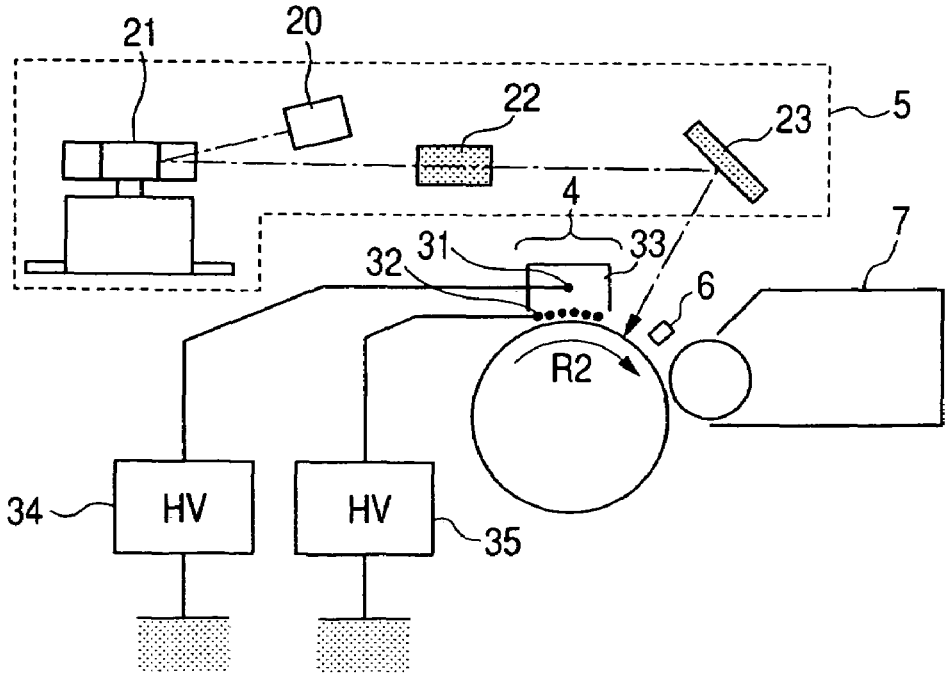
FIG. 2 is a view showing a charging apparatus and an exposure apparatus.

As shown in FIG. 2, the exposure apparatus 5 is provided with a semiconductor laser 20 for emitting a laser light in response to an image signal, a polygon mirror 21 for putting the irradiating laser light into a scanning motion, an imaging lens 22 for focusing the laser light in scanning motion, and a mirror 23 for guiding the focused laser light onto the surface of the photosensitive drum 2 after charging.

Also as shown in FIG. 2, the primary charger 4 is provided with a discharge wire 31 for causing a discharge, a grid 32 for regulating the potential on the image bearing member at a predetermined potential, and a shield 33 for covering the discharge wire. The discharge wire 31 is a metal wire provided parallel to an axis of the photosensitive drum 2 (generatrix of the surface of the photosensitive drum 2). The discharge wire 31 is connected to a discharge wire high voltage source (first power source) 34 for applying a high voltage bias thereto. The discharge wire high voltage source 34 is capable, by first current supply control means, of arbitrarily setting a discharge current which is supplied under a constant current control to the discharge wire 31, within a range of 800-1600 μA based on the circuit design. The shield 33 is a metal plate of a square-U shaped cross section so formed as to cover the left, right and upper sides of the discharge wire 31, and to have an aperture in a portion opposed to the surface of the photosensitive drum 2. The grid 32 is constituted of plural parallel metal wires provided in the aperture of the shield 33. The grid 32 is connected to a grid high voltage source (second power source) 35 for applying a high voltage bias thereto. The grid high voltage source 35 is capable, by second current supply control means, of arbitrarily setting a voltage which is supplied under a constant current control to the grid 32, within a range up to 1100 V in the circuit design, but, for a reason to be explained later, an upper limit is selected as 900 V by a driving software sequence.

Now the function of the image forming apparatus of the above-described configuration will be briefly explained.

The photosensitive drum 2 is rotated, by drive means such as a motor and transmission gears, in a direction R2 with a predetermined process speed (peripheral speed) and the surface is uniformly charged by the primary charger 4 with a predetermined polarity and a predetermined potential. The surface of the photosensitive drum 2 after charging is subjected to an exposure by the exposure apparatus 5 according to image information whereby the charge in an exposed portion is removed to form an electrostatic latent image. The electrostatic latent image is subjected to a deposition of the toner by the developing apparatus 7 and is thus developed as a toner image.

On the other hand, a transfer material P is supplied from a sheet deck 11 by a feeding roller 12, and is conveyed by a conveying roller 13 to registration rollers 14. The transfer material P is once stopped by the registration rollers 14. The registration rollers 14 supply a transfer portion with the transfer material P so as to synchronize with the toner image on the photosensitive drum 2. The transfer material P supplied to the transfer portion is subjected to a transfer of the toner image from the photosensitive drum 2 by the transfer charger 8, and then separated from the surface of the photosensitive drum 2 by the separation charger 9. The photosensitive drum 2 after the separation of the transfer material P is subjected to a removal of the toner remaining on the surface (residual toner) by the cleaning means 10, then to a removal of a charge on the photosensitive drum by the charge eliminator, and is used in a next image formation.

On the other hand, the transfer material P after separation is conveyed by a conveyor belt 15 to a fixing apparatus 16, in which it is heated and pressed by a fixing roller 16*a* and a pressure roller 16*b* whereby the toner image on the transfer material is fixed thereto. The transfer material P after the toner image fixation is discharged by discharge rollers 17 onto a discharge tray 18. In this manner an image formation for a transfer material P is completed.

Figure 3:
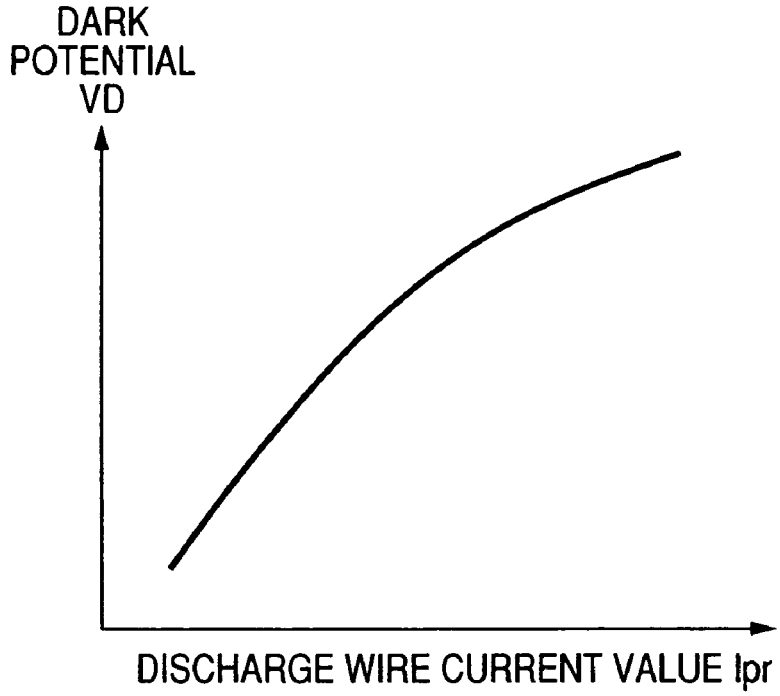
FIG. 3 is a chart showing a relationship between a current of a discharge wire and a dark potential when a grid voltage is fixed.

FIG. 3 is a chart showing a relationship between a current Ipr (horizontal axis) of the discharge wire 31 and a dark potential VD (vertical axis) of the surface of the photosensitive drum 2 in case the grid voltage of the primary charger 4 is fixed. As shown in FIG. 3, an increase in the current Ipr of the discharge wire 31 tends to cause an increase in the dark potential VD on the photosensitive drum 2. There has been widely employed a potential control method of regulating the current Ipr of the discharge wire 31 thereby bringing the dark potential VD to a target potential, utilizing the aforementioned tendency, while maintaining a constant grid voltage for example by a constant voltage element such as a varistor (not shown).

Figure 4:
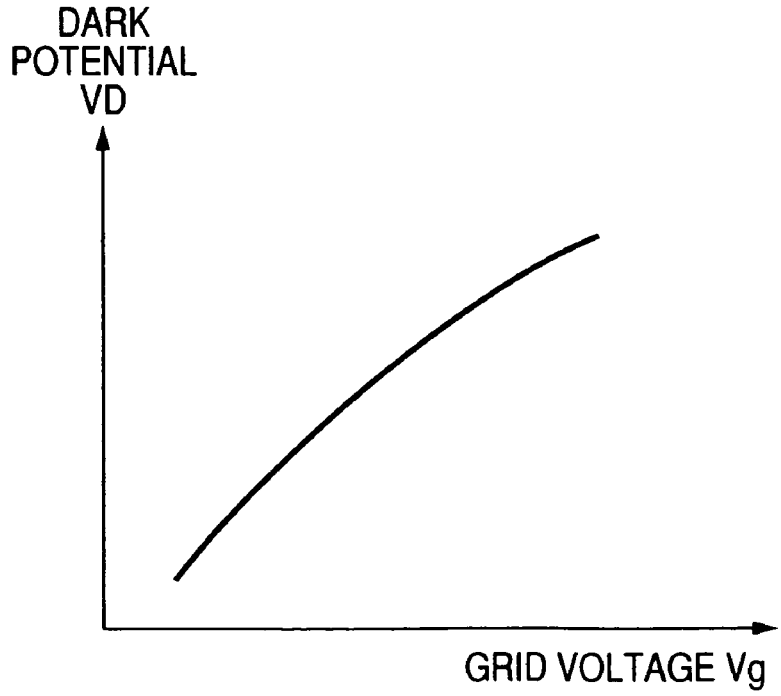
FIG. 4 is a chart showing a relationship between a grid voltage and a dark potential when a current of a discharge wire is fixed.

FIG. 4 is a chart showing a relationship between a grid voltage Vg (horizontal axis) and a dark potential VD (vertical axis) of the surface of the photosensitive drum 2 in case the current of the discharge wire 31 of the primary charger 4 is fixed. As shown in FIG. 4, an increase in the grid voltage Vg tends to cause an increase in the dark potential VD on the photosensitive drum 2. There has been widely employed a potential control method of regulating the grid voltage Vg thereby bringing the dark potential VD to a target potential, utilizing the aforementioned tendency, while maintaining a constant current in the discharge wire 31.

Figure 5:
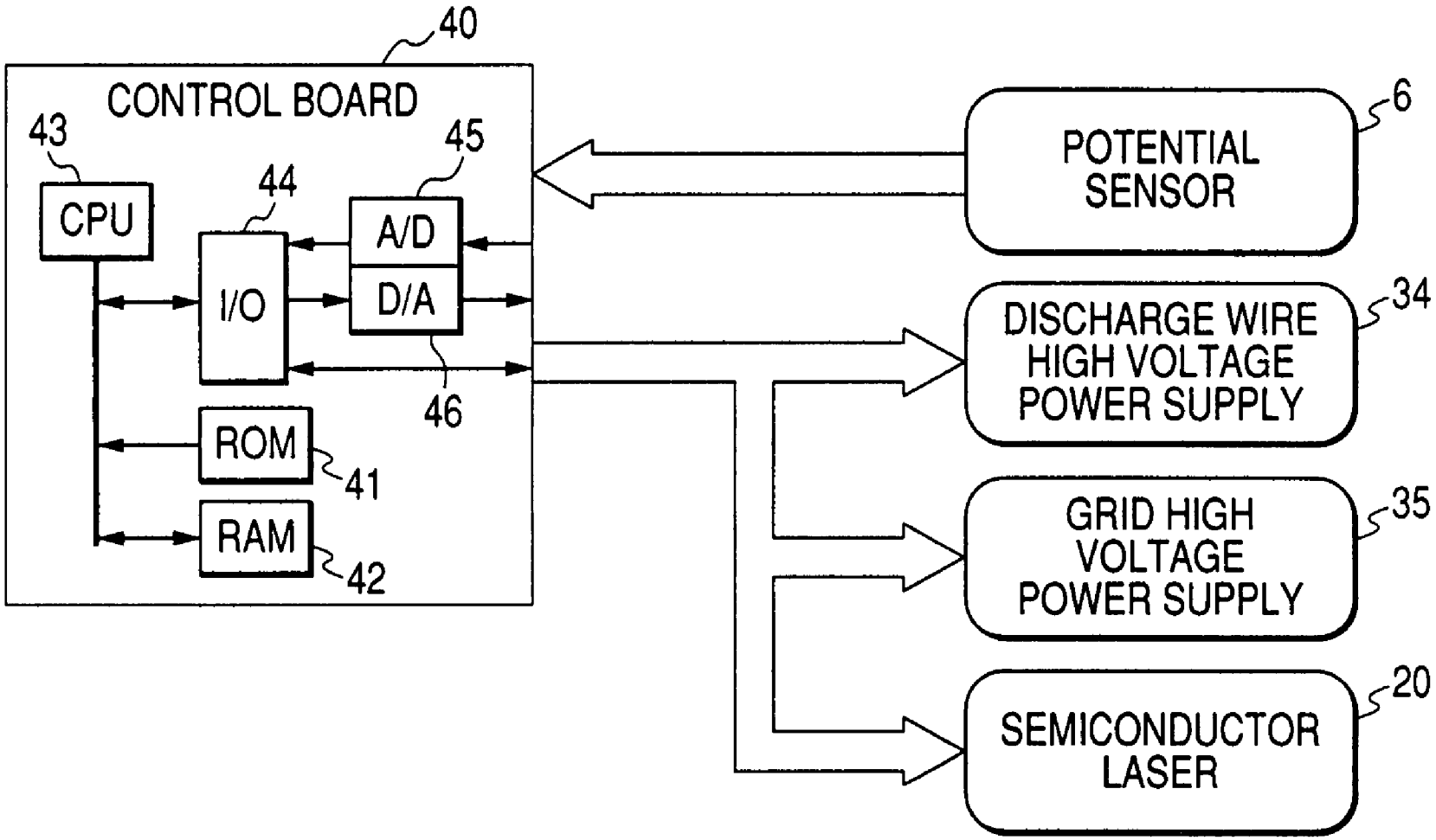
FIG. 5 is a schematic view showing an electrical configuration of a control board and its peripherals for executing a potential control of the present invention.

FIG. 5 is a schematic view showing an electrical configuration of a control board and its peripherals for executing a potential control of the present invention. Referring to FIG. 5, in a control board 40, a ROM 41 storing a control program and a RAM 42 which is a temporary memory element for necessary data of the program are connected to a central processing unit CPU (control means) 43. Also an interface I/O 44 and an A/D converter 45 and a D/A converter 46, constituting data converters, are connected to external peripheral equipment, whereby information can be entered into and outputted from the control board 40.

As a peripheral device of the invention, a potential sensor 6 can measure the potential on the photosensitive drum after charging and exposure. Also as output devices, there are connected a discharge wire high voltage source 34 for supplying the discharge wire 31 of the primary charger 4 with a high voltage bias, and a grid high voltage source 35 for supplying the grid 32 of the primary charger 4 with a high voltage bias. Also a semiconductor laser 20 is connected for forming a predetermined latent image potential corresponding to an image signal.

Figure 6:
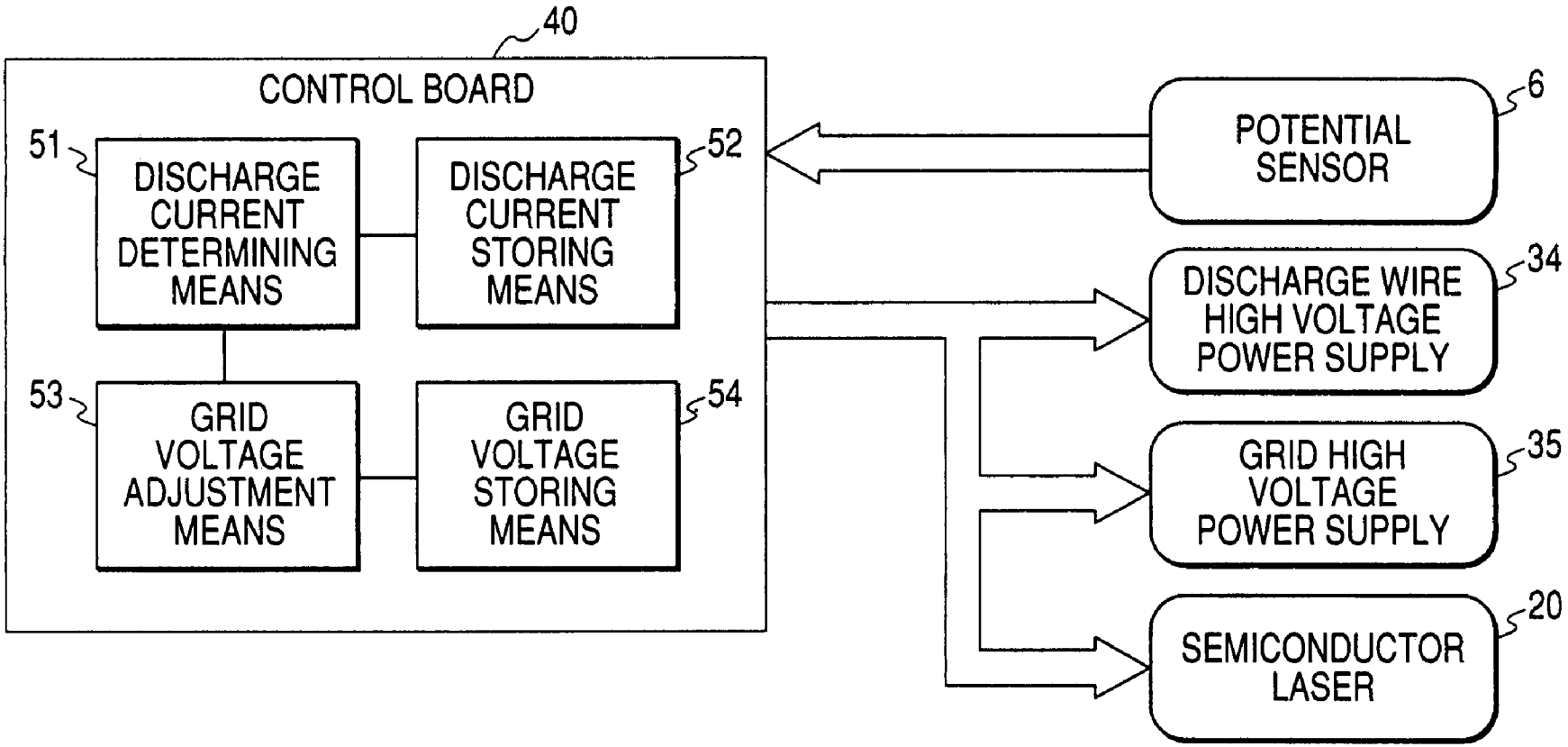
FIG. 6 is a block diagram of the potential control of the present invention.

FIG. 6 is a block diagram for explaining the function of the electrical configuration shown in FIG. 5, for the potential control of the present invention. Peripheral devices are constituted of the potential sensor 6, the discharge wire high voltage source 34, the grid high voltage source 35 and the semiconductor laser 20, and there are provided, for determining operating conditions thereof, first current supply condition selecting means (discharge current determination means) 51 for determining the current of the discharge wire 31, discharge current memory means (first memory means) 52 for memorizing the current, second current supply condition selecting means (grid voltage regulation means) 53 for regulating the grid voltage, and grid voltage memory means (second memory means) 54 for memorizing such voltage. The aforementioned means are constituted of the CPU 43, the ROM 41, the RAM 42 etc. shown in FIG. 5.

Figure 7:
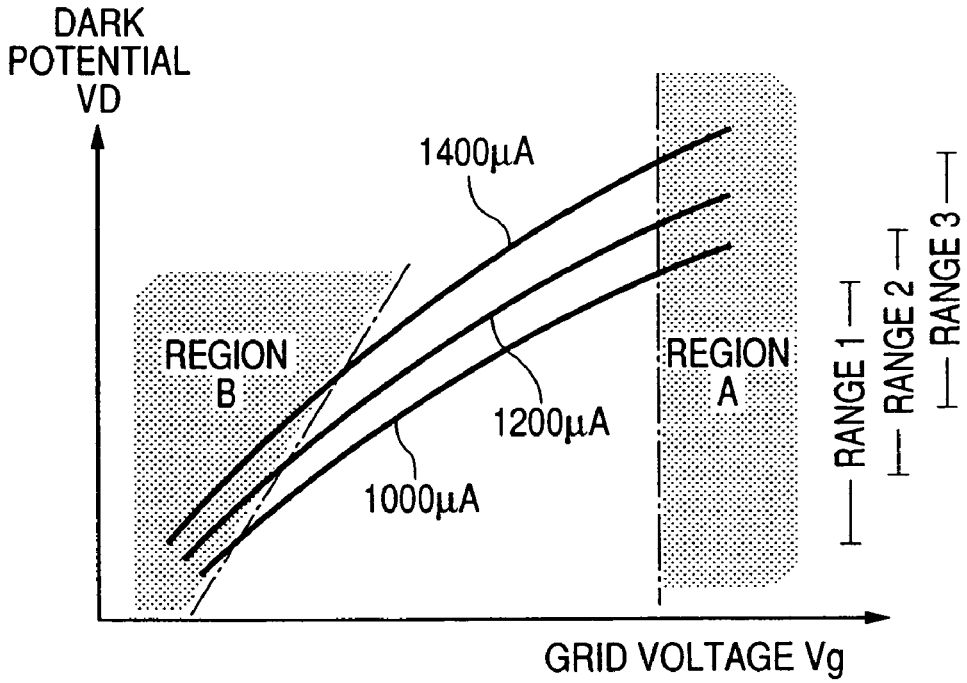
FIG. 7 is a chart showing a relationship among a current of a discharge wire, a grid voltage and a dark potential.

FIG. 7 is a chart showing a relationship among the current of the discharge wire 31, the grid voltage Vg and the dark potential VD, and illustrates the tendencies shown in FIGS. 2 and 3, as functions of the current of the discharge wire 31 and the voltage of the grid 32. For the convenience of explanation, the current of the discharge wire 31 is shown in three levels of 1000, 1200 and 1400 μA. These discharge characteristics have an upper limit and a lower limit.

A region A corresponds to a high voltage applied to the grid 32, equal to or higher than 900 V in the present embodiment. For example in case the grid voltage becomes higher than 900 V, a potential difference between the photosensitive drum 2 and the grid 32 shown in FIG. 4 may become 900 V or higher, whereby an abnormal spark discharge may be generated between the photosensitive drum 2 and the grid 32. In the present embodiment, the photosensitive drum 2 and the grid 32 has a distance of 1 mm. Such spark discharge tends to be generated when the photosensitive drum 2 and the grid 32 are positioned closer by a fluctuation in the production. Such spark discharge cannot achieve a uniform charging on the photosensitive drum 2, thereby resulting in an image defect such as an uneven charging or an abnormal density and eventually leading to an electrical destruction of the photosensitive drum 2. For these reasons, the voltage to be applied to the grid 32 has to be managed, and, for the state of the region A as shown in FIG. 7, 900 V is taken as an upper limit in the control board 40 for controlling the grid voltage or in the program for controlling control board 40.

However the boundary of such region A is variable depending on the properties of the photosensitive drum and the distance between the grid and the photosensitive drum, and is not limited to 900 V.

Also with respect to the setting of the lower limit voltage to be applied to the grid 32, a lower limit of the chargeable dark potential is set at a rather high level for a case of a high current to the discharge wire, while, for a case of a low current to the discharge wire, the lower limit of the chargeable dark potential is so set that the chargeable dark potential can vary from an upper limit, including the aforementioned lower limit value, to a value lower than the aforementioned lower limit. Such setting method allows to decrease the frequency of use of the high current to the discharge wire, thereby decelerating the smear on the discharge wire.

In the present embodiment, a region B corresponding to a low voltage applied to the grid 32 is defined by a output stability of the high voltage circuit. In the present embodiment, because of the circuit designs of the discharge wire high voltage source 34 and the grid high voltage source 35, the current applied to the discharge wire 31 is correlated with the lower limit of the voltage to be applied to the grid 32. The circuits of the present embodiment had such a relation that the lower limit of the voltage to be applied to the grid 32 was defined by the current applied to the discharge wire 31 times 230 kΩ. More specifically, the lower limit voltage was 230 V for a current of 1000 μA, 276 V for a current of 1200 μA and 322 V for a current of 1400 μA.

The region B not necessarily be defined as explained above but can also be defined, for example, by a frequency of the dark potential set at an image formation.

Since the grid voltage Vg is limited by such regions A and B, it will be understood, from FIG. 7, that the control range of the dark potential VD is limited to either of ranges 1, 2 and 3 corresponding to three currents applied to the discharge wire 31. It will therefore be understood that, in case a wide control range is desired, a mere regulation of the grid voltage Vg only cannot provide such wide control range. In measurements by the present inventors with a fixed positional relationship of the discharge wire 31, the shield 33 and the photosensitive drum 2 and under constant conditions of pressure, temperature and humidity, the range 1 was 120-350 V, the range 2 was 170-400 V and the range 3 was 230-480 V.

Figure 8:
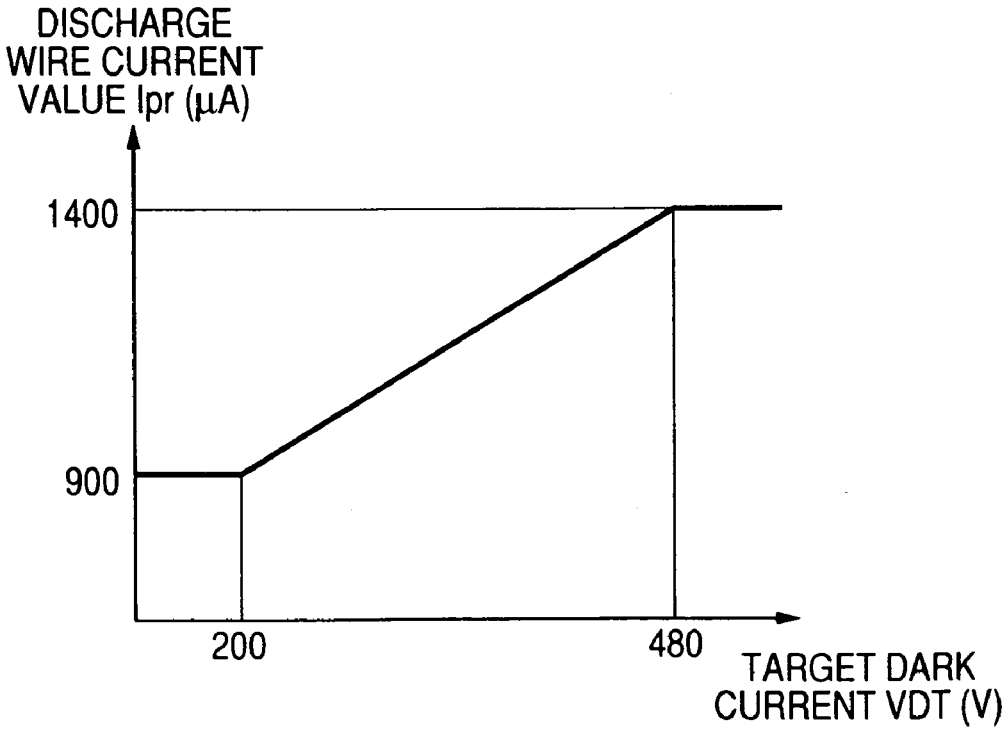
FIG. 8 is a chart showing a determination table for a target dark potential and a current of a discharge wire in an embodiment 1.

FIG. 8 is a view showing a table for determining a target dark potential VDT and a current of the discharge wire 31 in the present embodiment. In the present embodiment, a potential control is executed by taking a surface potential of the photosensitive drum 2, at the position of the potential sensor 6, as a target dark potential VDT. The target dark potential VDT is determined for each temperature and humidity in which the image forming apparatus 1 is located, in order to compensate an environmental dependence for example of the developing apparatus 7. As will be understood from FIG. 8, the current applied to the discharge wire 31 is selected lower for a lower target dark potential VDT. However software limitations are provided with a lower limit of 900 μA and an upper limit of 1400 μA in such a manner that the discharge wire current does not increase beyond such upper limit nor decrease below such lower limit.

Figure 9:
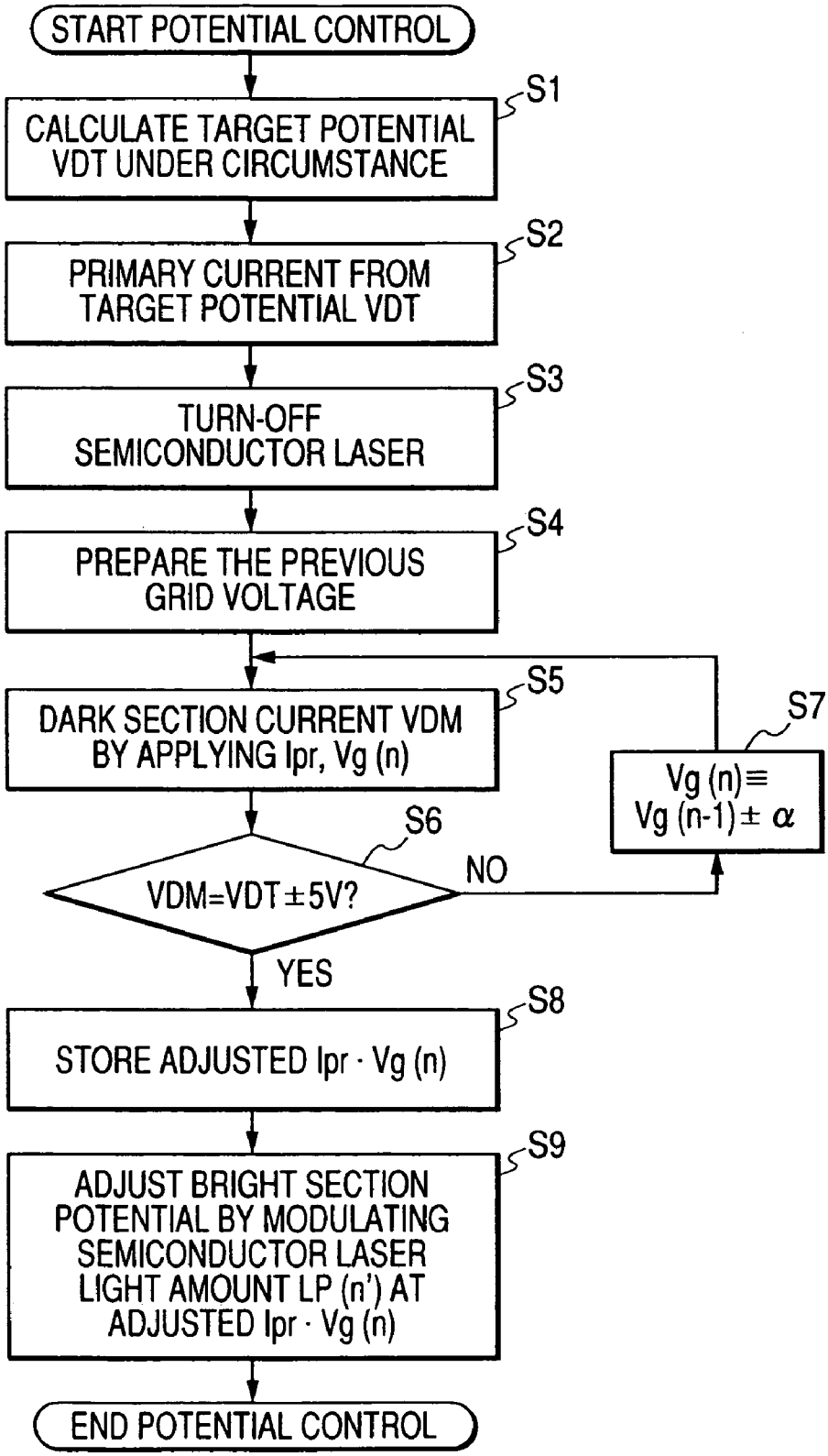
FIG. 9 is a flow chart showing a potential control in the embodiment 1.

FIG. 9 is a flow chart showing the potential control of the present embodiment.

At first, as described above, an environment in which the image forming apparatus 1 is placed is detected to calculate a target dark potential VDT (S1). Based on this determined dark potential VDT, a current Ipr of the discharge wire 31 is determined from the determination table shown in FIG. 8 (S2). Then the semiconductor laser 20 is turned off (S3), and a grid voltage Vg(0) used previously is prepared (S4). The grid voltage Vg(0) used previously is a value determined an immediately preceding potential control, and may be a default value in a first control. The current Ipr of the discharge wire 31 and the grid voltage Vg(0) are applied under the aforementioned conditions, and a dark potential VDM is measured (S5).

Then the measured dark potential VDM is compared with the target dark potential VDT to judge whether it is approximately close thereto (±5 V) (S6). If it is not approximately close, the grid voltage is regulated (S7) and the dark potential is measured again (S5). A number n, indicating the number of measurements of the dark potential and regulations of the grid voltage, is selected as 20 at maximum, and an error indication (not shown) will be given in an abnormal case where the measured potential VDM does not become approximately close to the target potential VDT even after such 20 cycles. When an approximately close situation is reached, thus determined current Ipr of the discharge wire 31 and the regulated grid voltage Vg(n) are memorized (S8), the semiconductor laser 20 is turned on with these values, and a light potential is regulated by modulating a light amount LP(n') (S9), whereupon the potential control is terminated.

Figure 10:
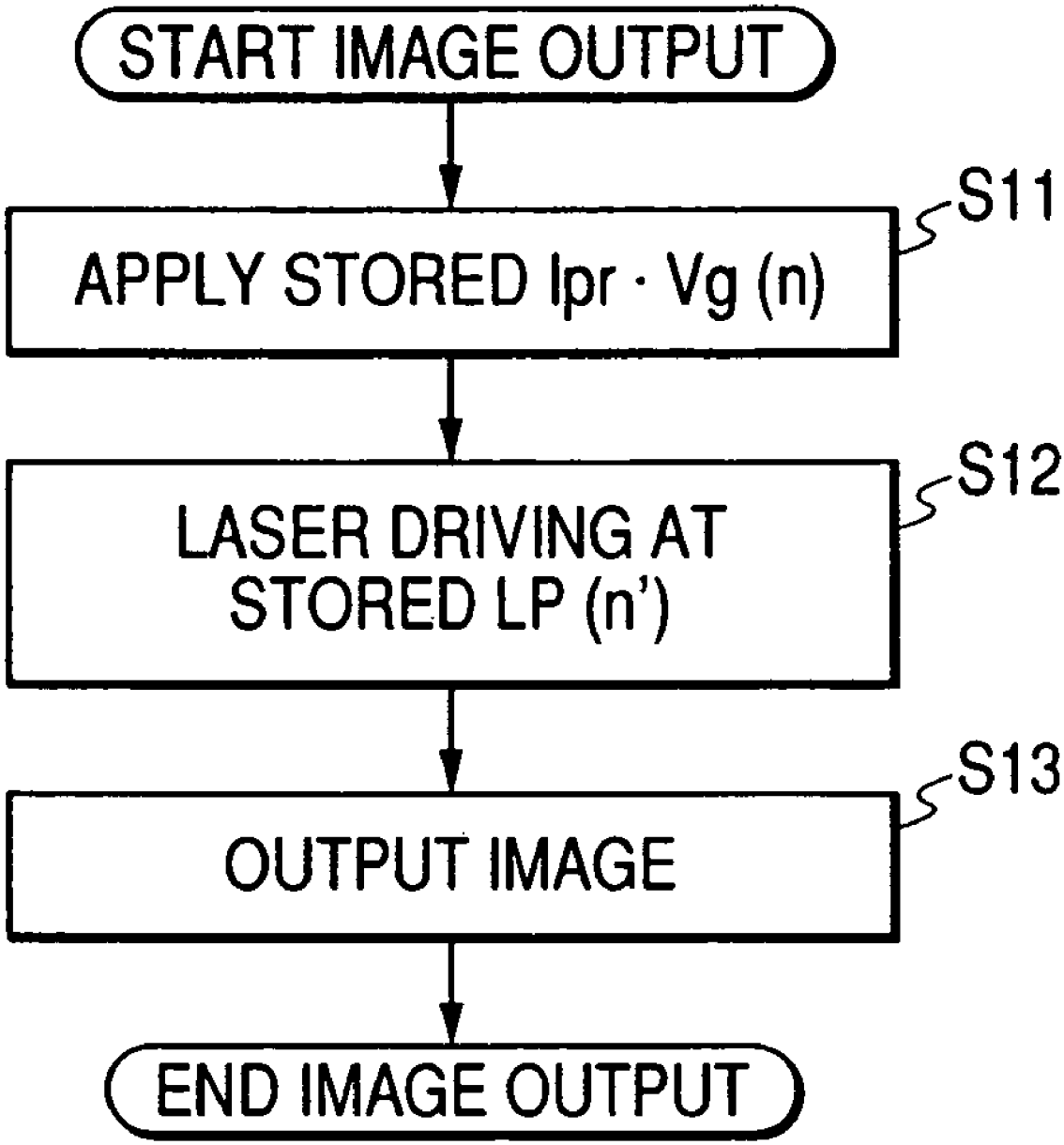
FIG. 10 is a flow chart showing an image output in the embodiment 1.

FIG. 10 is a flow chart showing an image output in the present embodiment. The current Ipr for the discharge wire 31 and the grid voltage Vg(n), which have been determined in the potential control shown in FIG. 9, are applied (S11), and the semiconductor laser 20 is driven with the light amount LP(n') which has also been determined in the potential control (S12). An image output is executed according to an image signal in such state (S13).

In the present embodiment, as explained in the foregoing, the current Ipr of the discharge wire 31 corresponding to the target dark potential VDT is determined from the determination table, and the grid voltage Vg(n) is regulated under such condition. Therefore, the control range is made wider in comparison with the prior technology, as shown in FIG. 11. In the prior technology, for example when the current of the discharge wire is fixed at 1200 μA, the final control range of the dark potential is limited to 170-400 V. On the other hand, in the present embodiment, since the current of discharge wire 31 is determined according to the target dark potential VDT, the control range of the dark potential is made as wide as 100-480 V.

In the present embodiment, there has been explained a method of determining the current of discharge wire 31 as a first bias according to the target dark potential and regulating the voltage of the grid 32 as a second bias based on such current, but there can also be adopted a method of determining the voltage of the grid 32 according to the target dark potential and regulating the current of the discharge wire 31 based on such voltage. It is naturally possible also to determine or regulate the voltage applied to the discharge wire 31, or to determine or regulate the current of the grid 32.

Therefore, in the present invention, 8 combinations in total are possible. In case of firstly determining a bias (current or voltage) applied to the discharge wire 31 and then regulating a bias (current or voltage) applied to the grid 32, four combinations are possible including two combinations of determining the current of the discharge wire 31 and regulating the current or the voltage of the grid 32, and two combinations of determining the voltage of the discharge wire 31 and regulating the current or the voltage of the grid 32. On the other hand, in case of firstly determining a bias (current or voltage) applied to the grid 32 and then regulating a bias (current or voltage) applied to the discharge wire 31, four combinations are possible including two combinations of determining the current of the grid 32 and regulating the current or the voltage of the discharge wire 31, and two combinations of determining the voltage of the grid 32 and regulating the current or the voltage of the discharge wire 31.

Embodiment 2

In the foregoing embodiment 1, there has been explained a case of utilizing a single determination table between the target dark potential and the current of the discharge wire 31. In the present embodiment, there will be explained a potential control having plural determination tables with different relationships between the set potential and the selected current supply condition.

Figure 12:
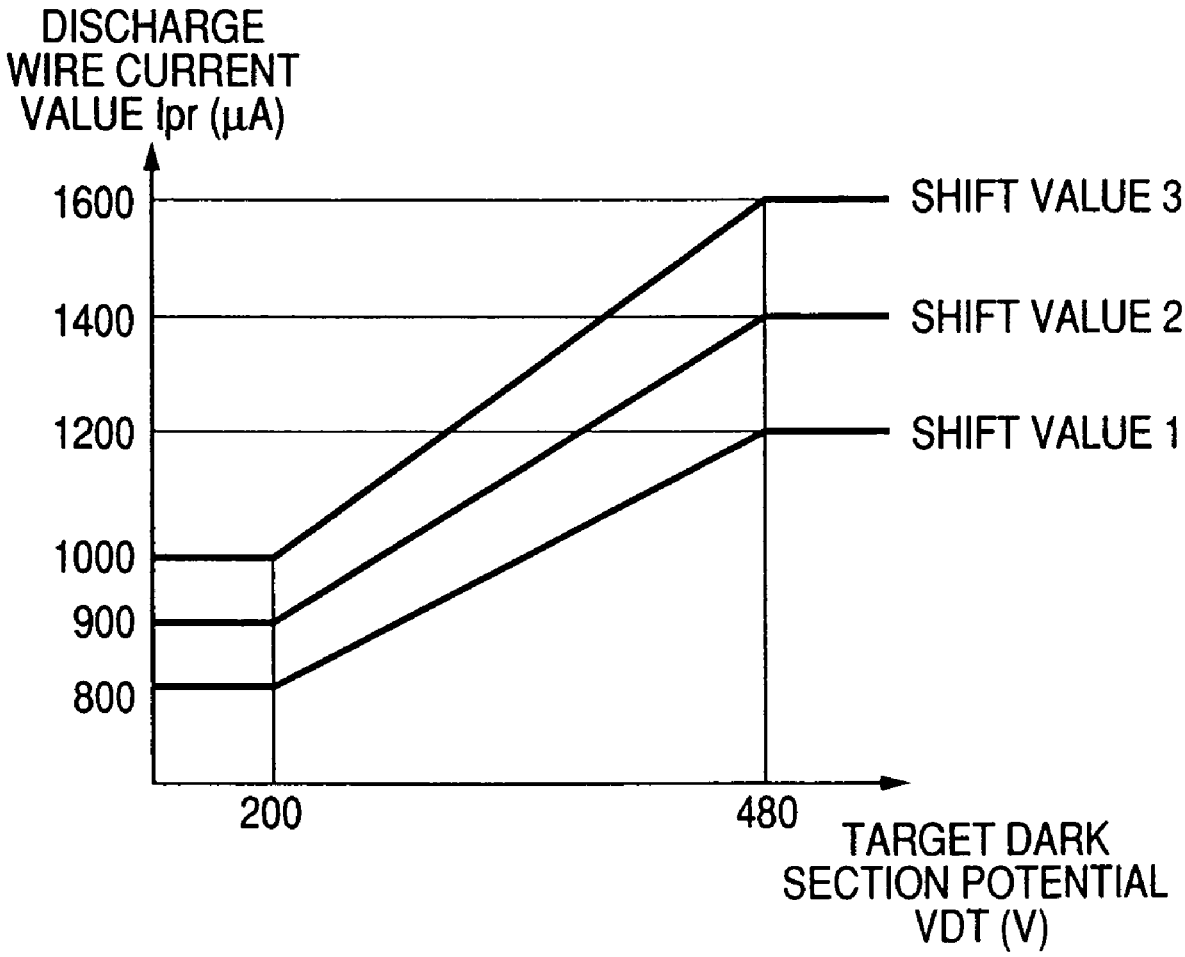
FIG. 12 is a chart showing a determination table for a target dark potential and a current of a discharge wire in an embodiment 2.

FIG. 12 shows a determination table for the target dark potential VDT and the current of the discharge wire 31 in the present embodiment. As will be apparent from FIG. 12, there are provided three tables (shift value 1, shift value 2 and shift value 3). Three tables mean three stages of a current shift switch for shifting the setting of the discharge wire 31, and one of such three stages is selected as a setting by the service personnel (plural selection modes).

In the present embodiment, the current shift switch selects a shift value according to the image forming operation, but it is also possible to change the shift value from an operation panel (not shown) of the main body 1*a* of the image forming apparatus by a software, or to utilize a hardware switch. In these three tables, as in the table of the embodiment 1 shown in FIG. 8, the current applied to the discharge wire 31 is made lower for a lower target dark potential VDT. Also a lower limit and a higher limit are provided by a software in such a manner that the discharge wire current does not increase beyond such upper limit nor decrease below such lower limit.

Figure 13:
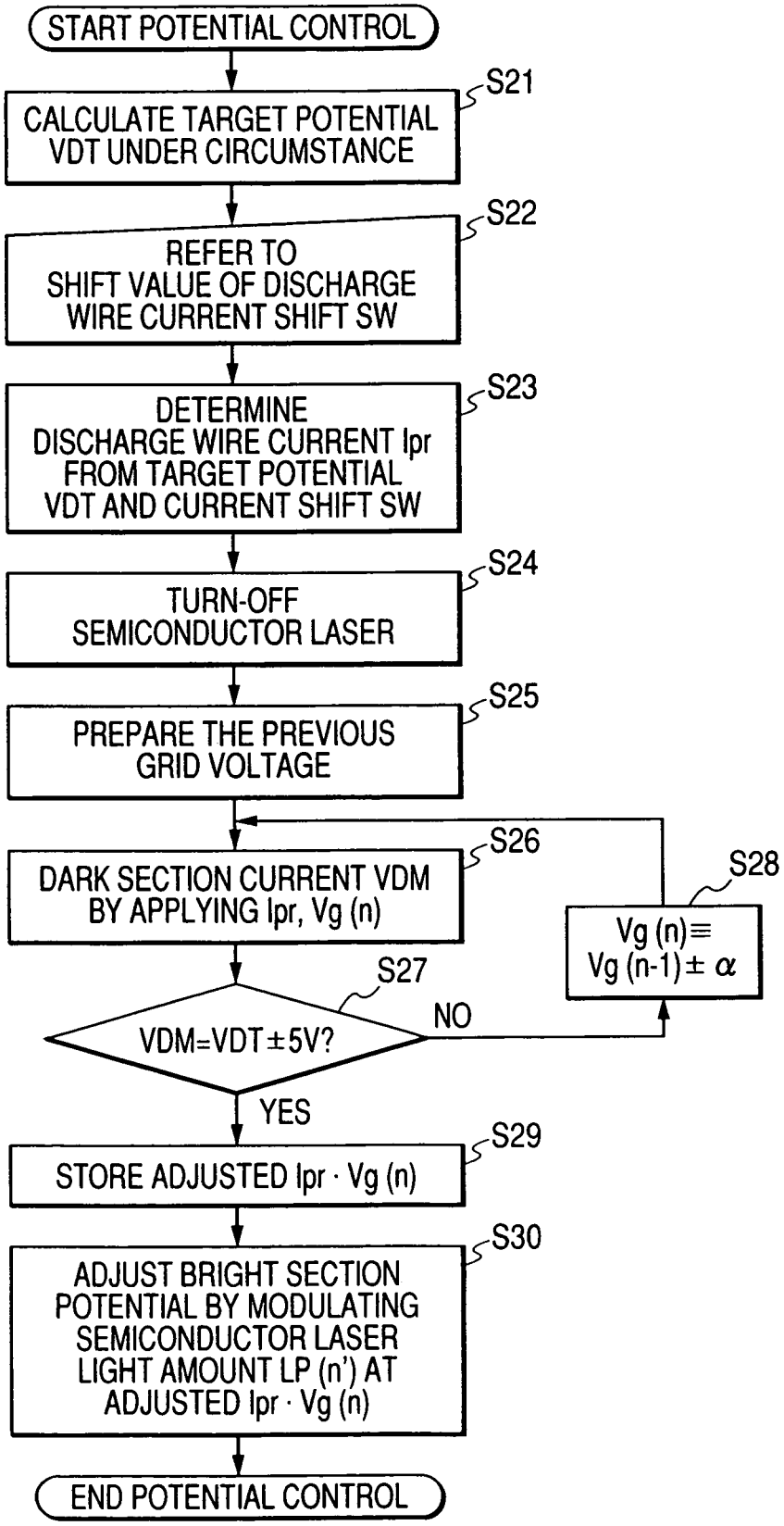
FIG. 13 is a flow chart showing a potential control in an embodiment 2.

Switching of the shift switch will be explained. The present embodiment is provided with an environment sensor for detecting the environment, and the shift value is switched according to the humidity. In a high humidity environment of a relative humidity of 80 to 100%, an amount of the toner deposited on the photosensitive drum by the development means is reduced, so that the target potential is so set as to facilitate the toner deposition on the photosensitive drum. Therefore, there is selected the shift value 3 for enabling a setting of a high potential, in order to obtain a high contrast with the developing bias. In a low humidity environment of a relative humidity of 0-30%, an amount of the toner deposited on the photosensitive drum by the development means is increased, so that the target potential is so set as to decrease the toner deposition on the photosensitive drum. Therefore, there is selected the shift value 1 for enabling a setting of a low potential, in order to obtain a low contrast with the developing bias. Also in a low humidity environment of a relative humidity of 30-80%, the shift value 2 is selected. The current of the discharge wire is selected for the setting of the target potential, within the range of the shift value selected according to the environment. As to the setting of the target potential within the range of the shift value, there may be employed a method of reducing the potential setting in case a smaller deposited toner amount is desired for a recording material such as a transparent sheet or a thin recording material. Also the potential setting may be switched according to the image mode. n FIG. 13 is a flow chart showing the potential control of the present embodiment.

At first, an environment in which the image forming apparatus 1 is placed is detected to calculate a target dark potential VDT (S21). Then a current shift value is read, by referring to the current shift switch for the discharge wire 31, set in the image forming apparatus (S22). Based on thus determined dark potential VDT and the shift value of the current shift switch, a current Ipr of the discharge wire 31 is determined from the table shown in FIG. 12 (S23). Then the semiconductor laser 20 is turned off (S24), and a grid voltage Vg(0) used previously is prepared (S25). The current Ipr of the discharge wire 31 and the grid voltage Vg(0) are applied under the aforementioned conditions, and a dark potential VDM is measured (S26). Then the measured dark potential VDM is compared with the target dark potential VDT to judge whether it is approximately close thereto (±5 V) (S27). If it is not approximately close, the grid voltage is regulated (S28) and the dark potential is measured again (S26). A number n, indicating the number of measurements of the dark potential and regulations of the grid voltage, is selected as 20 at maximum, and an error indication (not shown) will be given in an abnormal case where the measured potential VDM does not become approximately close to the target potential VDT even after such 20 cycles. When an approximately close situation is reached, thus determined current Ipr of the discharge wire 31 and the regulated grid voltage Vg(n) are memorized (S29), the semiconductor laser 20 is turned on with these values, and a light potential is regulated by modulating a light amount LP(n') (S30), whereupon the potential control is terminated.

Thus, in the present embodiment, three tables are selectable arbitrarily, and the potential control range can be made wider than in the embodiment 1, in combination with a variation of the current of the discharge wire 31 according to the target dark potential. The present embodiment is effective not only in widening the potential control range but also, based on such effect, in providing a desirable current against fluctuations in the main body 1*a* of the image forming apparatus such as a fluctuation in the positional relationship among the discharge wire 31, the shield 33 and the photosensitive drum 2 and a fluctuation in the charging characteristics of the photosensitive drum 2.

In case a position adjusting mechanism (not shown) for adjusting the inclination of the discharge distribution of the discharge wire 31 is provided in the primary charger 4, it is naturally unavoidable that the positional relationship among the discharge wire 31, the shield 33 and the photosensitive drum 2 becomes different among different image forming apparatuses. More specifically, in case the distance between the discharge wire 31 and the photosensitive drum 2 is short, the discharge wire 31 does not require a large current since the dark potential can be easily increased. On the other hand, in case the distance is larger, the discharge wire 31 requires a larger current. Also the charging characteristics of the photosensitive drum 2 is associated with a fluctuation, so that the current required in the discharge wire 31 may become different for different photosensitive drums 2 even under identical conditions for obtaining a same dark potential.

Also, though not adopted in the present embodiment, in case the photosensitive drum 2 has plural rotation speeds or plural process speeds, there may be involved a parameter other than the target dark potential. Therefore, the configuration of the present embodiment having a current shift switch for the discharge wire 31, when used in combination with a method of determining the current of the discharge wire 31 according to the target dark potential, allows to respond to wider settings or fluctuations of the image forming apparatus 1, thereby widening the control range of the potential control and to simply achieve the optimum potential control thereby further improving the convenience of use.

In the present embodiment, the shift value is switched according to the environment, but it is possible also to switch the shift value according to a mode as will be explained in the following. The shift value 3 for providing a larger discharge current is selected in case priority is given to a high image quality though the service life of the discharge wire is shortened by a smear. Also the shift value 1 for providing a smaller discharge current is selected in case priority is given to a longer service life of the discharge wire, determined by the smear. The shift value 2 is selected in case priority is not given to the service life of the discharge wire nor to the image quality.

Naturally the selection of the shift values is not limited to such example.

Embodiment 3

The present embodiment explains a case where the image forming apparatus 1 has plural image modes. The present embodiment has a copy mode in which an image is formed from image information of image reading means of the image forming apparatus, and a printer mode in which an image is formed from transmitted image information, and the target dark potential is made different for a copy output and for a printer output. This is because the image formation is different for a copy obtained from an original image and for a print obtained from a signal. In the present embodiment, the target potential is selected, in the copy mode, so as to obtain a larger toner deposition on a line, and, in the printer mode, so as to a smaller toner deposition on a same line. In the following, there will be explained switching of the setting of the target potential according to the copy mode and the printer mode.

Figure 14:
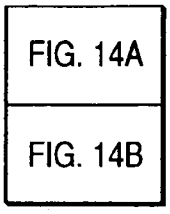
FIG. 14 which is composed of FIGS. 14A and 14B are flow charts of a potential control in an embodiment 3.
Figure 14A:
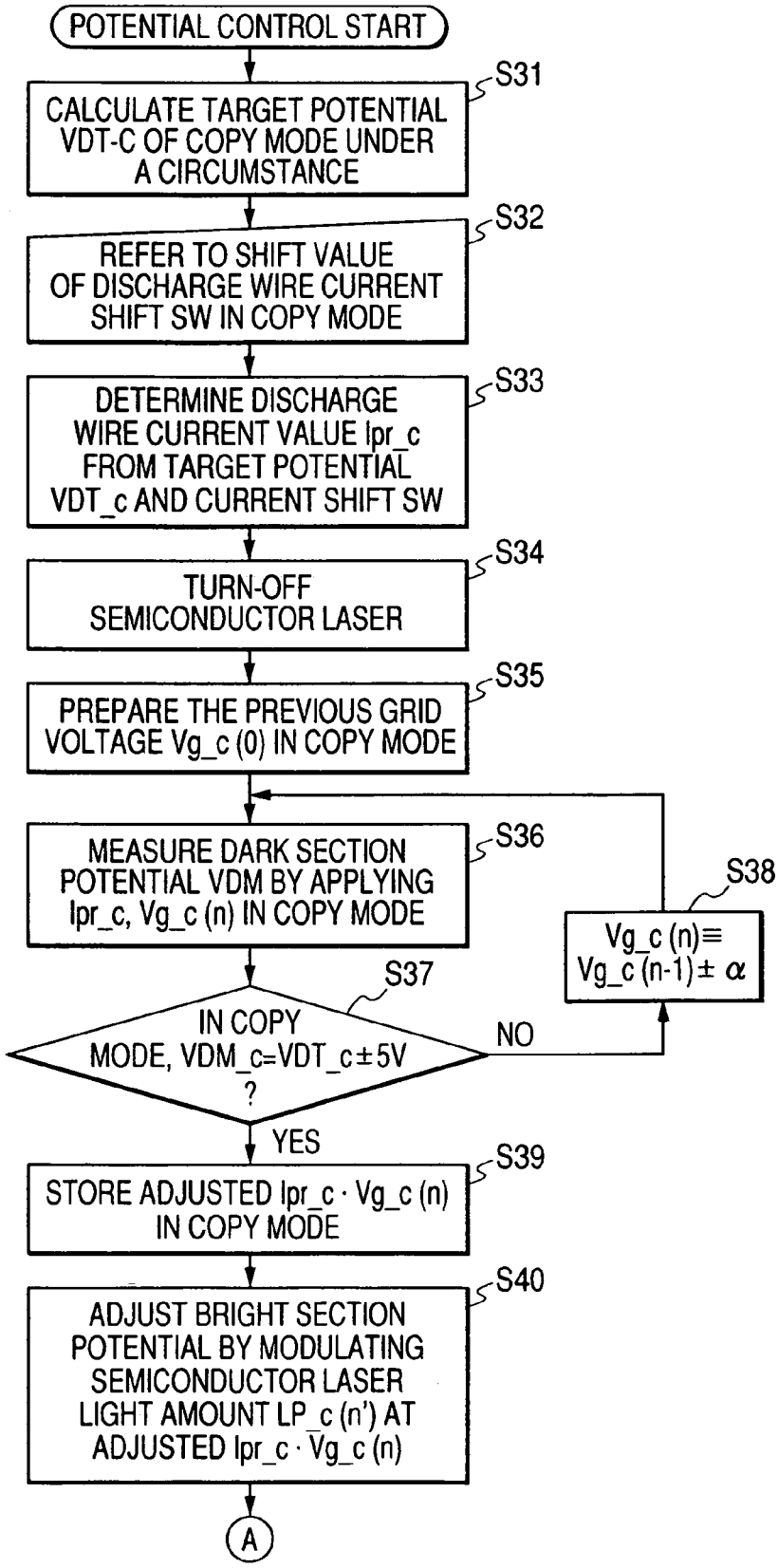
Figure 14B:
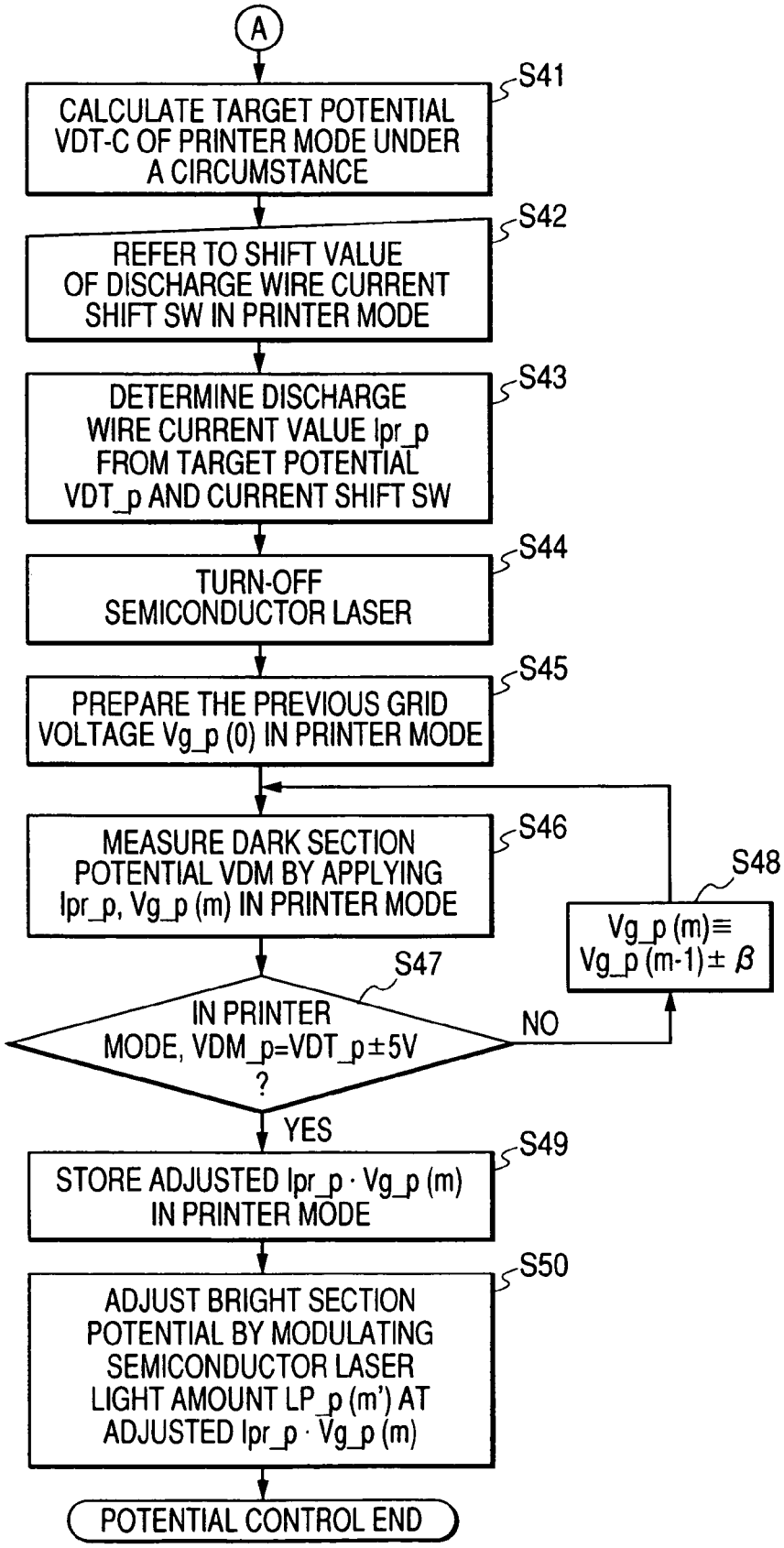

FIG. 14 which is composed of FIGS. 14A and 14B are flow charts of the potential control of the present embodiment.

At first, an environment in which the image forming apparatus 1 is placed is detected to calculate a target dark potential VDTc in a copy mode (S31). Then a current shift value in the copy mode is read, by referring to the current shift switch for the discharge wire 31, set in the image forming apparatus 1 (S32). Based on thus determined dark potential VDTc in the copy mode and the shift value of the current shift switch, a current Iprc of the discharge wire 31 in the copy mode is determined from the table shown in FIG. 12 (S33). Then the semiconductor laser 20 is turned off (S34), and a grid voltage Vgc(0) used previously in the copy mode is prepared (S35). The current Iprc of the discharge wire 31 and the grid voltage Vgc(0) in the copy mode are applied under the aforementioned conditions, and a dark potential VDMc is measured (S36).

Then the measured dark potential VDMc is compared with the target dark potential VDTc to judge whether it is approximately close thereto (±5 V) (S37). If it is not approximately close, the grid voltage is regulated (S38) and the dark potential is measured again (S36). A number n, indicating the number of measurements of the dark potential and regulations of the grid voltage, is selected as 20 at maximum, and an error indication (not shown) will be given in an abnormal case where the measured potential VDMc does not become approximately close to the target potential VDTc even after such 20 cycles. When an approximately close situation is reached, thus determined current Iprc of the discharge wire 31 and the regulated grid voltage Vgc(n) are memorized (S39), the semiconductor laser 20 is turned on with these values, and a light potential is regulated by modulating a light amount LPc(n') (S40), whereupon the potential control for the copy mode is terminated.

Then, an environment in which the image forming apparatus 1 is placed is detected to calculate a target dark potential VDTp in a printer mode (S41). Then a current shift value in the printer mode is read, by referring to the current shift switch for the discharge wire 31, set in the image forming apparatus 1 (S42). Based on thus determined dark potential VDTp in the printer mode and the shift value of the current shift switch, a current Iprp of the discharge wire 31 in the printer mode is determined from the table shown in FIG. 12 (S43). Then the semiconductor laser 20 is turned off (S44), and a grid voltage Vgp(0) used previously in the printer mode is prepared (S45). The current Iprp of the discharge wire 31 and the grid voltage Vgp(0) in the printer mode are applied under the aforementioned conditions, and a dark potential VDMp is measured (S46).

Then the measured dark potential VDMp is compared with the target dark potential VDTP to judge whether it is approximately close thereto (±5 V) (S47). If it is not approximately close, the grid voltage is regulated (S48) and the dark potential is measured again (S46). A number m, indicating the number of measurements of the dark potential and regulations of the grid voltage, is selected as 20 at maximum, and an error indication (not shown) will be given in an abnormal case where the measured potential VDMp does not become approximately close to the target potential VDTc even after such 20 cycles. When an approximately close situation is reached, thus determined current Iprp of the discharge wire 31 and the regulated grid voltage Vgp(m) are memorized (S49), the semiconductor laser 20 is turned on with these values, and a light potential is regulated by modulating a light amount LPc(m') (S50), whereupon the potential control for the copy mode is terminated.

Figure 15:
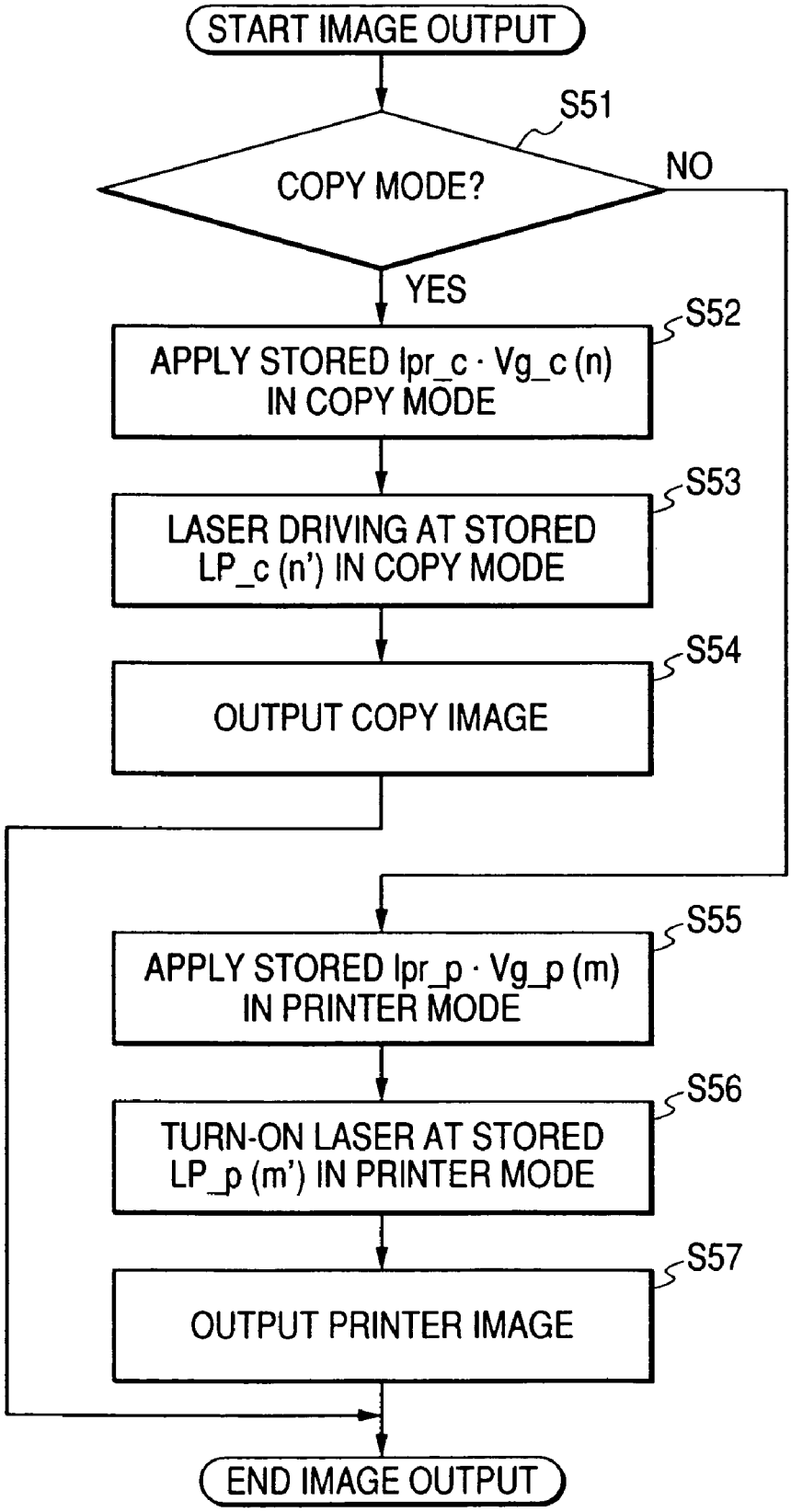
FIG. 15 is a flow chart showing an image output in the embodiment 3.

FIG. 15 is a flow chart showing an image output in the present embodiment. In case of an image output, there is discriminated whether the output is to be executed in the copy mode or in the printer mode (S51), and, in case of the copy mode, the current Iprc for the discharge wire 31 and the grid voltage Vgc(n), which have been determined in the potential control shown in FIGS. 14A and 14B, are applied (S52), and the semiconductor laser 20 is driven with the light amount LPc(n') which has also been determined in the potential control (S53). An image output is executed according to an image signal in such state (S54). Also in case of the printer mode, the current Iprp for the discharge wire 31 and the grid voltage Vgp(m) of the printer mode are applied (S55), and the semiconductor laser 20 is driven with the light amount LPp(m') which has also been determined in the potential control (S56). An image output is executed according to an image signal in such state (S57).

The present embodiment, as explained in the foregoing, stores a current value of the discharge wire 31 and a grid voltage for each of plural image modes and assumes appropriate values for each image mode at the image output, thereby enabling to widen the control range of the potential control regardless of the image mode and to achieve an optimum potential control in a simple manner.

The foregoing embodiments employ a process of transferring a toner image on the photosensitive drum directly onto a recording material, but the present invention is likewise applicable to a configuration of a color image forming apparatus in which a toner image on the photosensitive drum is once transferred onto an intermediate transfer member and then transferred therefrom onto a recording material.

The present invention enables a potential regulation over a wide range within a short time, without involving a constantly increased current to the discharge wire.

The present invention has been explained by embodiments thereof, but the present invention is not limited to such embodiments and is subject to any and all modifications within the technical concept of the invention.

This application claims priority from Japanese Patent Application No. 2003-428472 filed Dec. 24, 2003, which is hereby incorporated by reference herein.

What is claimed is:

1. An image forming apparatus comprising:

an image bearing member;

charging means, which charges the image bearing member, having a discharge wire and a grid;

first control means which controls a condition of a current supply to be supplied to the discharge wire;

second control means which controls a condition of a current supply to be supplied to the grid;

potential setting means which sets a potential on the image bearing means to be charged by the charging means;

first determining means, which determines the condition of the current supply controlled by one of the first control means or the second control means based on a preset table from the potential set by the potential setting means; and second determining means, which determines the condition of the current supply controlled by the other of the first control means or the second control means based on the determined current control condition.

2. An image forming apparatus according to claim 1, further comprising:

potential measurement means which measures a potential on the image bearing member, wherein the current control condition for the other of the first or second control means is determined based on a measured value of the potential measurement means.

3. An image forming apparatus according to claim 1, wherein the first determining means includes plural selection modes which are different in a relationship between the set potential and the selected determined condition of the current supply.

4. An image forming apparatus according to claim 3, wherein the plural selection modes are selected according to an environment.

5. An image forming apparatus according to claim 1, further comprising:

reading means which reads an image, wherein the set potential is different for a first mode in which an image formation is executed according to information of the reading means, and for a second mode in which an image formation is executed according to a communicated image information.

6. An image forming apparatus according to claim 1, wherein a condition of the current supply to the discharge wire is a current value.

7. An image forming apparatus according to claim 1, wherein a condition of the current supply to the grid is a voltage value.

* * * * *

UNITED STATES PATENT AND TRADEMARK OFFICE

CERTIFICATE OF CORRECTION

PATENT NO. : 7,254,349 B2
APPLICATION NO. : 11/016873
DATED : August 7, 2007
INVENTOR(S) : Yuji Kamiya It is certified that error appears in the above-identified patent and that said Letters Patent is hereby corrected as shown below:

ON THE TITLE PAGE:
At Item (56), References Cited, Foreign Patent Documents, Line 2, "11184215" should read --11-184215--.

COLUMN 6:
Line 59, "by a" should read --by an--.

COLUMN 7:
Line 4, "not necessarily be" should read --does not necessarily have to be--.
Line 47, "determined" should read --determined by--.

COLUMN 9:
Line 43, "mode. n" should read --mode.--.

COLUMN 12:
Line 2, "VDTP" should read --$VDT_P$--.

Signed and Sealed this

Third Day of June, 2008

JON W. DUDAS
*Director of the United States Patent and Trademark Office*